US008430406B2

(12) United States Patent
Gilula

(10) Patent No.: US 8,430,406 B2
(45) **Date of Patent: *Apr. 30, 2013**

(54) CARD GAME WITH CARD EXCHANGE FEATURE

(76) Inventor: Zvi Gilula, Chicago, IL (US)

( * ) Notice: Subject to any disclaimer, the term of this patent is extended or adjusted under 35 U.S.C. 154(b) by 3 days.

This patent is subject to a terminal disclaimer.

(21) Appl. No.: 13/295,512

(22) Filed: Nov. 14, 2011

(65) Prior Publication Data

US 2013/0023315 A1 Jan. 24, 2013

Related U.S. Application Data

(63) Continuation-in-part of application No. 13/187,108, filed on Jul. 20, 2011, now Pat. No. 8,356,817.

(51) Int. Cl.
*A63F 1/00* (2006.01)

(52) U.S. Cl.
USPC ..... 273/292

(58) Field of Classification Search ..... 273/292
See application file for complete search history.

(56) References Cited

U.S. PATENT DOCUMENTS 4,743,022 A 5/1988 Wood
5,019,973 A 5/1991 Wilcox et al.
5,275,416 A * 1/1994 Schorr et al. ..... 273/292
5,437,451 A 8/1995 Fulton
5,531,448 A 7/1996 Moody
5,722,661 A 3/1998 Skratulia et al.
5,732,950 A 3/1998 Moody
5,816,916 A 10/1998 Moody
5,823,873 A 10/1998 Moody
5,868,618 A 2/1999 Netley et al.
5,897,436 A 4/1999 Singer et al.
5,947,821 A 9/1999 Stone
5,976,016 A 11/1999 Moody et al.
6,007,066 A 12/1999 Moody
6,050,568 A 4/2000 Hachquet
6,098,985 A 8/2000 Moody
6,120,378 A 9/2000 Moody et al.
6,248,016 B1 6/2001 Walker et al.
6,270,405 B1 8/2001 Ferguson
6,371,484 B1 4/2002 Yuan
6,416,407 B1 7/2002 Carrico et al.
6,419,578 B1 7/2002 Moody et al.
6,471,587 B1 10/2002 Wood et al.
6,474,645 B2 11/2002 Tarantino
6,481,717 B1 11/2002 Richardelle
6,585,588 B2 7/2003 Hartl
6,612,927 B1 9/2003 Slomiany et al.
6,638,163 B2 10/2003 Moody
6,672,959 B2 1/2004 Moody et al.
6,729,621 B2 5/2004 Moody (Continued)

*Primary Examiner* — Michael Dennis
(74) *Attorney, Agent, or Firm* — Weide & Miller, Ltd.

(57) ABSTRACT

A card game includes a card exchange feature. In a poker variation, a dealer is dealt an initial hand and a player is dealt an initial hand. The player is permitted to elect to exchange none, one or more or all of the cards in their hand with cards from the dealer's hand. Elected cards are then exchanged with the dealer's hand and a final player and a final dealer hand are formed from the original hands as modified by any exchanged cards. The rank of the player's final hand is then compared to the rank of the dealer's final hand and the player's hand is declared to be the winner if it outranks the dealer's hand.

7 Claims, 4 Drawing Sheets

U.S. PATENT DOCUMENTS

| | | | |
|---|---|---|---|
| 6,729,961 | B1 | 5/2004 | Millerschone |
| 6,802,773 | B2 | 10/2004 | Moody |
| 6,802,774 | B1 | 10/2004 | Carlson et al. |
| 6,913,531 | B1 | 7/2005 | Yoeloff |
| 7,201,654 | B1 | 4/2007 | Jarvis et al. |
| 2002/0198040 | A1 | 12/2002 | Moody |
| 2003/0032469 | A1 | 2/2003 | Moody et al. |
| 2003/0038425 | A1 | 2/2003 | Tarantino |
| 2003/0100357 | A1 | 5/2003 | Walker et al. |
| 2003/0107176 | A1 | 6/2003 | Goldman et al. |
| 2003/0122305 | A1 | 7/2003 | Malcolm |
| 2003/0130023 | A1 | 7/2003 | Angel |
| 2005/0037839 | A1 | 2/2005 | Yoseloff |
| 2006/0125178 | A1* | 6/2006 | Weiss ..... 273/292 |

* cited by examiner

CARD GAME WITH CARD EXCHANGE FEATURE

RELATED APPLICATION DATA

This application is a continuation-in-part of U.S. application Ser. No. 13/187,108, filed Jul. 20, 2011 now U.S. Pat. No. 8,356,817.

FIELD OF THE INVENTION

The present invention relates to methods and devices for presenting and playing games

BACKGROUND OF THE INVENTION

Casinos continue to seek new and exciting games to present to players in order to maintain player interest. One of the most popular casino or wagering-style games is poker, including the variation presented at a gaming machine known as video poker. In the game of video poker, a player attempts to form one or more hands of cards which are compared against a pay table of winning hands. The player attempts to achieve one of the winning hands in the pay table in order to receive a payout or award.

One of the most basic forms of video poker is "draw" video poker. In accordance with this game, a player is dealt a single hand of cards and then is given the opportunity to discard and replace one or more of those cards (i.e. "draw" one or more replacement cards). The player's final hand comprising the original cards and as replaced by any replacement cards is then evaluated against the pay table of winning hands.

In order to make the game of video poker more exciting, numerous variations of the game have been developed. For example, in the variation known as Triple Play™ offered by IGT, a player is dealt a hand of cards and elects cards to be held. The cards held in the base hand are replicated into one or more additional hands. Each hand is then completed with one or more additional cards and those multiple hands are then all evaluated against the pay table of winning hands. While this game has been extremely popular, players still desire and seek out even newer games, including poker and video poker games.

SUMMARY OF THE INVENTION

Aspects of the invention comprise methods of playing and presenting games and gaming machines configured to present games.

In a preferred embodiment a game of the invention comprises a card game which includes a card exchange feature. In a poker variation, a dealer is dealt an initial hand of cards and a player is dealt an initial hand of cards. The player is permitted to elect to exchange none, one or more or all of the cards in their hand with cards from the dealer's hand. Elected cards are then exchanged with the dealer's hand and a final player hand and a final dealer hand are formed from the original hands as modified by any exchange of cards. The rank of the player's final hand is then compared to the rank of the dealer's final hand and the player's hand is declared to be the winner if it outranks the dealer's hand.

In one embodiment, the player's initial hand and the dealer's initial hand each comprise five (5) cards. The dealer's initial cards are preferably not disclosed to the player, such as by dealing or displaying them face down, while the player is permitted to evaluate their initial cards, such as by dealing or displaying the player's cards face up.

In one embodiment, any cards which the player designates to be exchanged are exchanged or swapped with cards in corresponding positions of the dealer's initial hand. The final hands may be evaluated based upon standard poker hand rankings, including in accordance with a pay table which defines winning and/or losing outcomes.

Preferably, the game is played as a wagering game. In such an implementation, the player may be paid winnings for winning outcomes based upon the pay table. If the player's final hand is of the same rank as the dealer's final hand, the outcome of the game may be a tie and the player's wager may be returned. If the dealer's final hand outranks the player's final hand, then the player preferably loses their wager. In other embodiments, if the player's hand and the dealer's hand tie, then the player's hand may be declared to be winning.

In another embodiment of the invention, a player may play both for a predetermined winning outcome and against the dealer's hand. In such a configuration, a player may be paid winnings for achieving a predetermined winning hand even though the player's hand did not beat the dealer's hand. The player may be paid additional winnings if their hand also beats the dealer's hand.

In yet another embodiment of the invention, a player may play against two or more dealer hands. In one configuration, a player is dealt a single initial hand. The player is permitted to swap cards from their initial hand with multiple dealer hands, thus forming a corresponding number of different final player hands. Each of those final player hands corresponds to a final dealer hand and the corresponding hands are compared to determine the outcome of the game. The player may be paid winnings for each dealer hand that the player beats.

The game of the invention may be implemented using physical cards, such as at a gaming table. Preferably, however, the games of the invention are implemented by a gaming machine. Such machine may include a wager accepting device and a controller configured to execute software which implements the steps of the invention. Game information, such as images of the cards comprising the player's initial hand, the dealer's initial hand and the final hands after any swapping of cards, may be displayed on an electronic display of the gaming machine.

In accordance with the invention, an exciting new card game is presented in which a player has the opportunity to swap or exchange cards with a dealer or other opponent. The card swap feature introduces strategy and mystery into the game as the player attempts to better their initial hand while at the same time not bettering the dealer's hand as a result of potential card swapping.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One embodiment of the invention comprises methods of playing and presenting games. Another aspect of the invention comprises gaming devices and systems for presenting games of the invention.

In general, one embodiment of the invention is a poker-type card game having a card exchange feature. In accordance with a preferred embodiment of the invention, a player and a dealer are each dealt a hand of cards. The player is then permitted to exchange none, one or more or all of their cards with the same number of cards from the dealer's hand. It is then determined if the player's final hand, which includes any exchanged cards from the dealer's hand, comprises a winning outcome, such as by comparing a rank of the player's hand to a rank of the dealer's hand to determine which hand has the highest rank.

Figure 1:
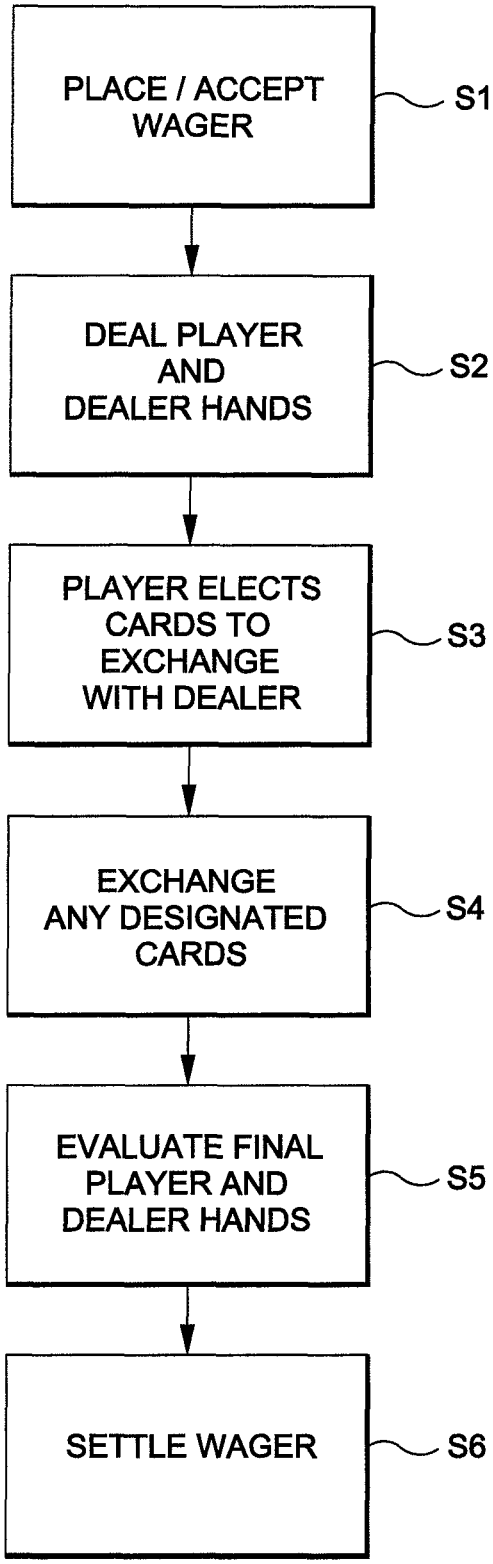
FIG. 1 is a flow diagram illustrating one method of presenting and playing a game in accordance with the invention.

A method of playing and presenting a game in accordance with the invention will be described first with reference to FIG. 1.

Preferably, the game of the invention is played and presented as a wagering type game. In that event, in a step S1, the player places a wager and that wager is accepted, such as by the casino offering the game. As is known, the wager preferably comprises monies (coins, paper currency) or monetary equivalent (such as chips or credits). Of course, the form of the wager and how it is presented and accepted may vary. For example, if the game is presented at a table using physical cards, the player may place the wager using chips. If the game is presented at an electronic gaming machine, the player may place the wager by providing monetary value to the gaming machine and then wagering one or more credits. Of course, other forms of wagers may be utilized including points, free games, etc.

In a step S2, an initial hand of cards is dealt to the player and an initial hand of cards is dealt to a dealer (as disclosed below, in various embodiments the player may play against two or more dealer hands). In one embodiment, each hand comprises an initial set of five (5) cards. However, it is possible for the hands of cards to comprise other numbers of cards. Preferably, the player's hand and the dealer's hand each have the same number of cards.

In a preferred embodiment, the player's cards are revealed to the player, such as by dealing or displaying them face up. Preferably, the dealer's cards are not revealed to the player, such as by dealing or displaying the dealer's cards face down.

In the case of a gaming machine, this step may comprise a controller of the gaming machine causing images of cards to be displayed on at least one video display of the gaming machine. In the case of a table-type game, this step may comprise the act of dealing physical cards, such as from a deck or shoe of cards.

In a step S3, the player elects to exchange or swap player cards with dealer cards. In a preferred embodiment, the player may elect to swap or exchange no cards or one or more cards, up to all of their cards. The player may provide input regarding the one or more cards to be retained/held or swapped. For example, relative to a video poker game, a player might push a "swap" button under each player card which the player wishes to swap with a dealer card, push a "hold" button under each player card which the player wishes to hold, and/or push a "swap" or "hold" button corresponding to the desired intent for each card.

In a step S4, each player card which the player elects to swap or exchange is exchanged with a dealer card. In a preferred embodiment, the dealer and player cards in corresponding positions are swapped. For example, in hands of five (5) cards having a $1^{st}$, $2^{nd}$, $3^{rd}$, $4^{th}$ and $5^{th}$ card position, a player's election to swap the player card in the $3^{rd}$ position causes that card to be exchanged with the dealer card in the same ($3^{rd}$) position of the dealer hand. In other embodiments, it may be possible for player cards to be swapped with dealer cards in random positions or in positions designated by the player (for example, the player might elect to swap the card in the $1^{st}$ position of their hand with the card in the $4^{th}$ position of the dealer hand).

Preferably, when a dealer card is exchanged with a player card, the exchanged dealer card is revealed to the player and it is associated with the player's hand. In this manner, the player can see the outcome of the card exchange, including the resulting cards comprising the player hand of cards.

In a step S5, after any card exchanges have occurred, final player and dealer hands are formed and then evaluated. In one embodiment, this comprises forming and revealing the dealer's final hand to the player. The final dealer hand comprises the initial set of cards dealt to the dealer as replaced by any cards which the player exchanged with the dealer's cards. In addition, any cards which were not displayed to the player, such as because they were originally dealt face down, are preferably turned over. The final player hand comprises the initial set of cards dealt to the player as replaced by any cards which the player exchanged with the dealer's cards.

Preferably, the outcome of the game is determined by comparing the final player and dealer's hands. In one embodiment, the rankings or values of the dealer and player hands are compared, such as in accordance with the standard rules of poker. If the player's hand outranks the resultant dealer hand, the player is declared to be the winner of the game. If the dealer's hand outranks the resultant player hand, the dealer is declared to be the winner of the game. If the final player and dealer hands have the same rank, the game may be declared to be a wash or a tie.

In one embodiment, in a step S6, the player's wager is settled. In a preferred embodiment, winnings are awarded to the player in the event the player wins the game, the player loses their wager if they lose the game, and the player's wager is returned if the outcome of the game is a tie. Winnings may be paid or awarded to the player in various fashions. For example, at a table game, the player may be paid or awarded chips. At a gaming machine, the player may be awarded credits or points, or monies may be dispensed to the player.

The amount of winnings awarded to a player for a player winning outcome may be determined based upon a pay table. One example of such a pay table is set forth below. In this preferred configuration, the winnings or payout for player winning outcomes depend upon the rank of the player's hand in relation to the rank of the dealer's (or computer's) hand. This pay table uses the standard poker hand rankings (from highest to lowest) of: Royal Flush (RF), Straight Flush (SF), Four of a Kind (FOAK), Full House (FH), Flush (FH), Straight (ST), Three of a Kind (TOAK), Two Pair (TP), One Pair (OP) and High Card (HC). For hands having the same general rank, high card may be used to determine a higher rank (wherein individual card are ranked from highest to lowest as A, K, Q, J, Ten, 9, 8, 7, 6, 5, 4, 3, and 2, such that, for example, a Pair of Aces beats a Pair of 7s).

TABLE 1

| | | Computer's Hand | | | | | | | | | |
|---|---|---|---|---|---|---|---|---|---|---|---|
| | | RF | SF | FOAK | FH | FL | ST | TOAK | TP | OP | HC |
| Player's Hand | RF | −1 | | | 20,000,000 | 3,500,000 | 900,000 | 300,000 | 150,000 | 15,000 | 12,000 |
| | SF | −1 | −1 | 10,000,000 | 1,200,000 | 600,000 | 250,000 | 60,000 | 25,000 | 2,800 | 1,200 |
| | FOAK | −1 | −1 | −1 | 28,000 | 22,000 | 8,000 | 1,500 | 750 | 100 | 75 |
| | FH | −1 | −1 | −1 | −1 | 3,000 | 1,500 | 250 | 150 | 30 | 15 |
| | FL | −1 | −1 | −1 | −1 | −1 | 1,000 | 200 | 100 | 15 | 10 |
| | ST | −1 | −1 | −1 | −1 | −1 | −1 | 130 | 50 | 8 | 7 |
| | TOAK | −1 | −1 | −1 | −1 | −1 | −1 | −1 | 20 | 6 | 4 |
| | TP | −1 | −1 | −1 | −1 | −1 | −1 | −1 | −1 | 3 | 2 |
| | OP | −1 | −1 | −1 | −1 | −1 | −1 | −1 | −1 | −1 | 1 |
| | HC | −1 | −1 | −1 | −1 | −1 | −1 | −1 | −1 | −1 | −1 |

One example of a game in accordance with the present invention will now be described with reference to FIGS. 2A-2C.

Figure 2A:
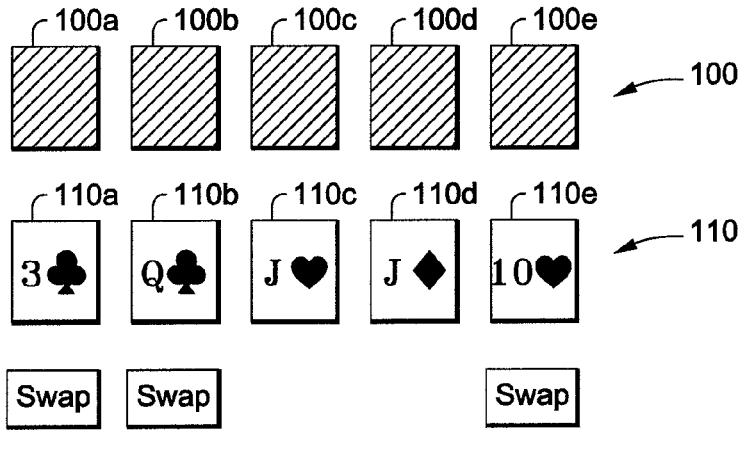
FIGS. 2A-2C illustrate one example of game play in accordance with the game of the invention.

Referring to FIG. 2A, once a player has placed a wager, an initial dealer hand 100 and an initial player hand 110 are dealt. In one embodiment, the dealer hand 100 comprises the five cards 100*a*, 100*b*, 100*c*, 100*d* and 100*e*. Likewise, the player hand 110 comprises the five cards 110*a*, 110*b*, 110*c*, 110*d*, and 110*e*.

In accordance with the preferred embodiment described above, the dealer's cards are dealt face down so that their value is not known to the player. On the other hand, the player's cards are dealt face up so that the player can evaluate their cards.

As indicated above, the player is permitted to swap or exchange as few as none or up to all of their cards with the dealer's cards. As described below, various strategies may be utilized by the player in determining which cards (if any) to swap with the dealer's cards.

In the example which is illustrated, the player's hand already includes a Pair of Jacks (cards 110*c* and 110*d*). The player has thus elected to swap or exchange their remaining three cards, namely cards 110*a*, 110*b* and 110*e*.

Figure 2B:
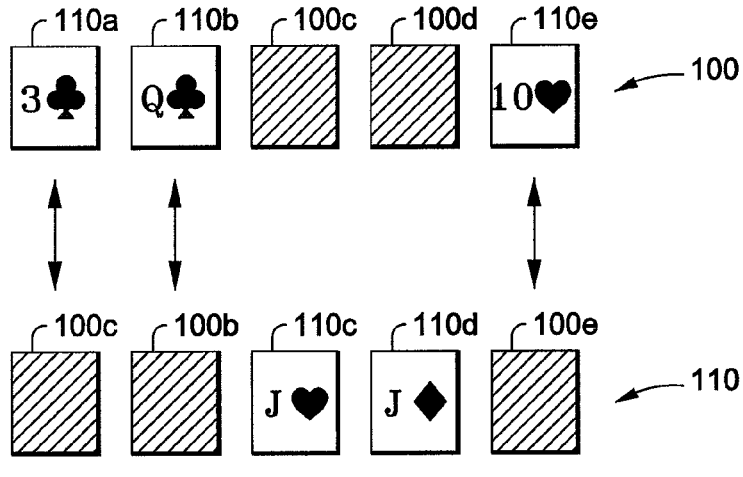
Figure 2C:
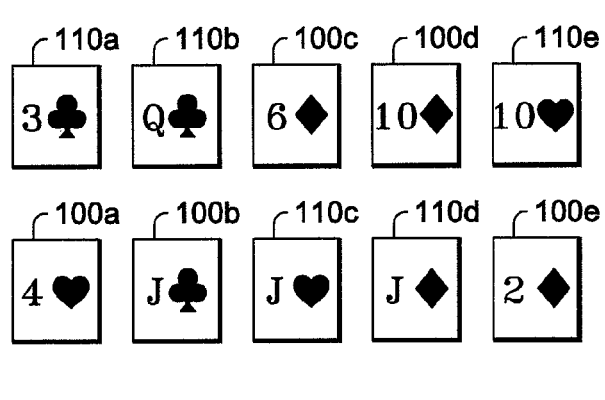

FIG. 2B illustrates the final dealer hand 100 and the final player hand 110 after the card exchange. As illustrated, the first player card, card 110*a*, has been exchanged with the first dealer card 100*a*. Likewise the player's second and fifth cards 110*b*, 110*e* have been exchanged with the corresponding dealer cards 100*b*, 100*e*.

Once all designated player cards have been swapped or exchanged, the two final hands are evaluated. FIG. 2C illustrates one example of the two final hands after all of the cards have been revealed. As illustrated, the dealer's final hand comprises the three swapped player cards 110*a*, 110*b* and 110*e*, plus the two original dealer cards 100*c* and 100*d*. These cards formed a dealer hand comprising a Pair of Tens (cards 100*d* and 110*e*). The player's final hand comprises the three swapped dealer cards 100*a*, 100*b* and 100*e*, plus the originally retained Pair of Jacks (cards 110*c* and 110*d*). In this example, the player's final hand comprises Three of a Kind (three Jacks comprising cards 100*b*, 110*c* and 110*d*).

In accordance with standard poker rules and the rules of this game, the player's hand of a Three of a Kind outranks the dealer's hand of a Pair of Tens. As such, the player's hand is deemed to be a winning hand and the player may be paid an award. In accordance with the example pay table illustrated above, that payout would be 6 credits for each credit wagered by the player (i.e. the player would be paid 6 credits if the player originally wagered 1 credit, and would be paid 12 credits if the player originally wagered 2 credits, etc.).

As indicated above, a player may elect to employ various strategies in selecting which cards, if any, to swap or exchange. In this regard, the card swap or exchange feature represents an exciting feature which greatly distinguishes the game from other poker and video poker games.

In particular, in accordance with the invention, a player must balance decisions to swap or exchanged cards for the purpose of improving their hand with the risk that the cards which are swapped are given to the dealer (and not merely discarded), such that the swapped cards may improve the dealer's hand and cause the dealer's hand to have a higher rank. For example, in the example illustrated in FIGS. 2A-2C, it will be seen that the result of the player swapping their fifth card 110*e* was to provide a Ten of Hearts to the dealer. Because the dealer already had a Ten of Diamonds as the fourth card 100*d* in the initial dealer hand 100, the player's swapping of the fifth card caused the dealer to end up with a Pair of Tens (when originally the dealers hand, before the cards were swapped, comprised a Queen high card only). In other words, the player's swapping of cards can improve the dealer's hand. Thus, for optimum play strategy, the player must evaluate the potential that they can improve their hand against the risk of improving the dealer's hand.

As another example, a player may be dealt the cards J, J, 2, A, 3. The player might hold the two Jacks and elect to swap the remaining three cards. In that event, if the dealer already holds an Ace, swapping of the player's Ace might result in the dealer's final hand comprising a Pair of Aces. Assuming that the player's hand did not improve, the card swap would thus result in the dealer's hand having a higher rank than the player's hand, when if the player had not swapped those cards, the player's hand would have been a winning hand.

Of course, the player may not employ the best or optimum card hold/swap strategy or may deviate from the optimum strategy, as desired. However, set forth below are examples of preferred or desired card hold/swap strategies.

First, if the player's initial hand already defines a Royal Flush, Straight Flush, Flush, Straight or Full House combination of cards, there is little chance that exchanging cards will improve that hand. In fact, in various of those instances a swap would necessarily destroy the hand (for example, in the case of a Royal Flush, exchanging any of the cards would destroy the Royal Flush because no replacement/swapped card could have a value which, in combination with the held cards, could result in a Royal Flush again). Thus, in such a configuration, the optimum play strategy is likely to be that the player holds all of their initial cards (i.e. does not swap or exchange any cards). In that event, the player's initial hand is compared to the dealer's initial hand in order to evaluate the outcome of the game.

Second, in the event the player's initial hand defines a Three of a Kind, the player will generally exchange the two remaining cards if they are of a lower rank than the cards comprising the Three of a Kind. If not, the player will generally keep all five initial cards.

Third, in the event the player's initial hand defines Two Pair, the player will generally exchange the remaining card if it is not the highest ranked card. Otherwise, the player will generally keep all five initial cards.

Fourth, in the event the player's initial hand defines a Pair, the player's strategy may depend on the card combinations. If the player's initial hand defines a Pair and four of the cards are of the same suit, then the player may wish to discard the one card of the other suit in attempt to obtain a Flush, so long as the one card of the other suit is one of the two cards comprising the Pair.

If the initial cards define a Pair but there are less than four cards of the same suit, then the player may wish to swap all cards having a value between 2 and 10 (i.e. swap all cards which are not an Ace or a face card).

Lastly, a player's initial hand may only define a high card. If three or more of the initial cards are of the same suit, the player may wish to hold those cards and swap the remaining two cards in an attempt to obtain a Flush. Otherwise, the player may wish to hold all cards comprising an Ace or a face card and swap all cards having a value between 2 and 10.

As indicated, these are merely preferred play strategies and a player may or may not wish to employ such strategies.

It will be appreciated that the methods of playing and presenting games of the invention may be implemented in various manners.

In one embodiment, the method of game play may be implemented using physical cards, such as at a gaming table. For example, the game could be played with a deck of fifty-two (52) cards of the four suits (such as ♠♣♥♦) each having cards with the values 2, 3, 4, 5, 6, 7, 8, 9, 10, Jack (J), Queen (Q), King (K) and Ace (A). Each card might comprise, for example, a media such as paper stock having a front and a back. Preferably, the front bears the card indicia. Preferably, the back is blank or printed with a pattern or the like, thus not providing any indication of the value of the card. Of course, the game might be played with multiple decks or "shoes" of cards. It is possible to play the game with other symbols, whether they are associated with cards or not (for example, the game might be played with dice indicia such as sides of dice having pips and where the player attempts to form combinations of dice).

Figure 4:
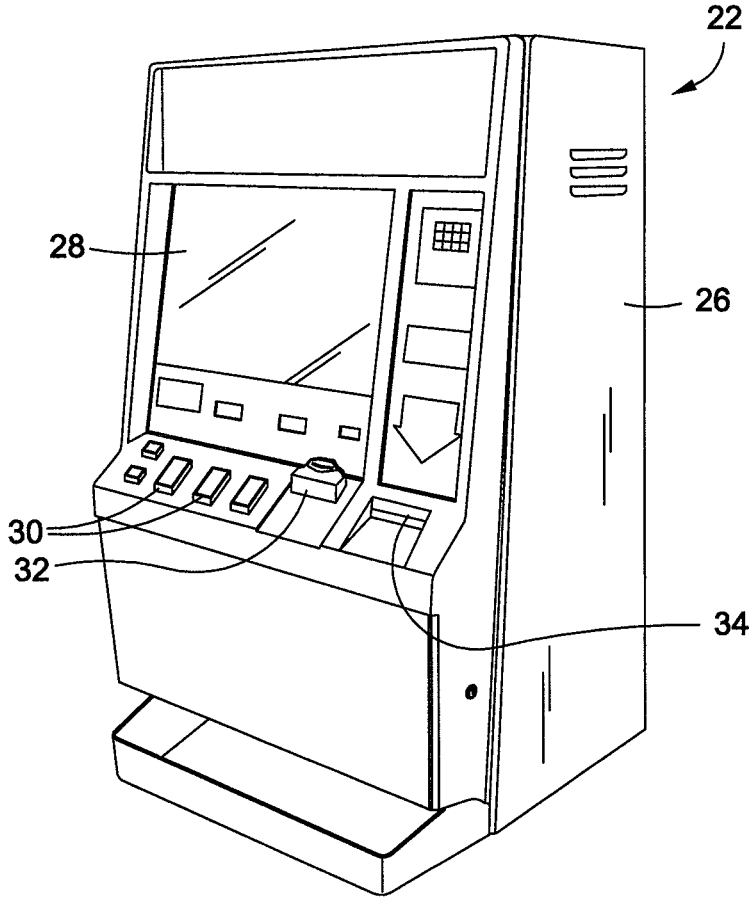
FIG. 4 illustrates a gaming machine configured to present games in accordance with the present invention.

In a preferred embodiment, however, the method of game play is implemented via a gaming machine or device. Such a gaming machine 22 may have various configurations. One configuration of a gaming machine is illustrated in FIG. 4. As illustrated, the gaming machine 22 generally comprises a housing or cabinet 26 for supporting and/or enclosing various components required for operation of the gaming machine. In the embodiment illustrated, the housing 26 includes a door located at a front thereof, the door capable of being moved between an open position which allows access to the interior, and a closed position in which access to the interior is generally prevented. The configuration of the gaming machine 22 may vary. In the embodiment illustrated, the gaming machine 22 has an "upright" configuration. However, the gaming machine 22 could have other configurations, shapes or dimensions (such as being of a "slant"-type, "bar-top" or other configuration as is well known to those of skill in the art).

The gaming machine 22 preferably includes at least one display device 28 configured to display game information. The display device 28 may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touch-screen, a light emitting display (LED) or other suitable displays now known or later developed, in a variety of resolutions, sizes and formats (e.g. 4:3, widescreen or the like). The display 28 may be capable of projecting or displaying a wide variety of information, including images, symbols and other indicia or information associated with game play, game promotion or other events.

As described in more detail below, the gaming machine 22 is preferably configured to present one or more games upon a player making a monetary payment or wager. In this regard, as described in more detail below, the gaming machine 22 includes means for accepting monetary value.

In one embodiment, as detailed above, certain game outcomes may be designated as winning outcomes. Prizes or awards may be provided for winning outcomes, such as monetary payments (or representations thereof, such as prize of credits), or promotional awards as detailed herein. As detailed below, the gaming machine 22 includes means for returning unused monetary funds and/or dispensing winnings to a player.

The gaming machine 22 preferably includes one or more player input devices 30 (such as input buttons, plunger mechanisms, a touch-screen display, joystick, touch-pad or the like). These one or more devices 30 may be utilized by the player to facilitate game play, such as by providing input or instruction to the gaming machine 22. For example, such input devices 30 may be utilized by a player to place a wager, cause the gaming machine 22 to initiate a game (such as spin slot reels or display cards in a video poker game), to indicate cards to be held or discarded in a game of video draw poker, to "cash out" of the gaming machine, or to provide various other inputs.

In one preferred embodiment, the gaming machine 22 includes at least one microprocessor or controller for controlling the gaming machine, including receiving player input and sending output signals for controlling the various components of the machine 22 (such as generating game information for display by the display 28). The controller may be arranged to receive information regarding funds provided by a player to the gaming machine, receive input such as a purchase/bet signal when a purchase/bet button is depressed, and receive other inputs from a player. The controller may be arranged to generate information regarding a game, such as generating game information for display by the at least one display 28 (such as information representing images of displayed cards), for determining winning or losing game outcomes and for displaying information regarding awards for winning game outcomes, among other things.

The controller may be configured to execute machine readable code or "software" or otherwise process information, such as obtained from a remote server. Software or other instructions may be stored on a memory or data storage device. The memory may also store other information, such as pay table information. The gaming machine 22 may also include one or more random number generators for generating random numbers, such as for use in selecting cards and for presenting the game in a random fashion.

Preferably, the controller is configured to execute machine readable code or instructions which are configured to implement the method of game play of the invention. For example, the controller of the gaming machine 22 may be configured to detect a wager, such as a signal from a player's depressing of the "bet one" button. Upon such an event and/or the player otherwise signaling the gaming machine to present the game, the controller may be configured to cause images of cards comprising an initial dealer hand and an initial player hand to be displayed on the at least one display 28. The controller may accept input from a player of one or more cards to be swapped. Such might comprise input signals from "swap" and/or "hold" buttons associated with each card of the player's initial hand. Based upon those signals, the controller may be configured to swap or exchange designated cards and thus display the final player and dealer hands upon the at least one display 28.

The gaming machine 22 may be configured to generate and present games in a stand-alone manner or it may be in communication with one or more external devices at one or more times. For example, the gaming machine 22 may be configured as a server based device and obtain game code or game outcome information from a remote game server (in which event the gaming machine controller may receive game information from the server, such as game outcome information, and use that server-generated information to present the game at the gaming machine).

As indicated, the gaming machine 22 is configured to present one or more wagering games. Thus, the gaming machines 22 is preferably configured to accept value, such as in the form of coins, tokens, paper currency or other elements or devices representing value such as monetary funds. For example, as illustrated in FIG. 1, the gaming machine 22 might include a coin acceptor 32 for accepting coins. Of course, associated coin reading/verifying devices and coin storage devices may be associated with the gaming machine 22 if it is configured to accept coins. Likewise, the gaming machine 22 might include a media reader 34. Such a reader may be configured to accept and read/verify paper currency and/or other media such as tickets. Of course, in such event the gaming machine 22 may further be configured with one or more paper currency or ticket storage devices, such as cash boxes, and other paper currency or media handling devices (including transport devices).

The gaming machine 22 might also be configured to read FOBs, magnetic stripe cards or other media having data associated therewith and via which value or funds may be associated with the gaming machine 22.

In one embodiment, the gaming machine 22 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. For example, upon an award or at cash-out, associated funds may be paid to the player by the gaming machine 22 dispensing coins to a coin tray 36. In another embodiment, funds may be issued by dispensing paper currency. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference.

It will be appreciated that the gaming machine illustrated in FIG. 4 is only exemplary of one embodiment of a gaming machine. For example, it is possible to for the gaming machine to have various other configurations, including different shapes and styles and having different components than as just described.

For example, it is possible for the game of the invention to be presented on a computing device, including at a home or office computer. In one embodiment, a player might log in to a casino server and the controller of the casino server may cause game information to be delivered to the player's computer and then be displayed on a display of the player's computer. In this regard, it will be noted that the term "controller" may comprise more than one device. For example, in a server-based environment, a controller at a server may generate game information and transmit that information to a local controller at a gaming machine. The local controller at the gaming machine may then cause game information to be displayed on the display of the gaming machine. The games of the invention could also be presented by or at hand-held devices, such as PDAs, cellular phones, tablet computing devices or the like.

As indicated above, the invention may have various embodiments, including various alternate forms of play. In addition, the invention has numerous benefits.

As one example, while the game has been described herein with reference to a dealer, it could be played in other formats. For example, the game could be played by two players where each player is dealt a hand. Each player could place a wager or bet and one of the players could be assigned the opportunity to make card swap elections. For example, a first player might initially be selected to make card swap elections and could retain that right so long as he or she won each round of the game (and if not, the right to make card swap elections could pass to a second player).

Because the game does not need to be played with a dealer per se, the hands of cards which are used to play the game may be referred to as first and second hands or the like, rather than "player" and "dealer" hands. As indicated above, the "dealer" hand may actually be a hand which is presented and played by a gaming machine or computer, rather than a living individual (though the game could be played by a player against a live dealer or secondary player).

It will be appreciated that the game of the invention may have numerous variations. For example, the game could be played with wild cards, such as wild "2s" or "Jacks" as is known in other poker games.

In a preferred embodiment, the player and dealer hands comprise sets of five (5) cards. It is possible for the hands to comprise other numbers of cards, including those being greater or less than five (5) cards. For example, each player and dealer hand might comprise seven (7) cards and those hands, including after any swapped cards, may again be evaluated for the best five (5) card hand formable from the seven (7) cards in the hand.

In one embodiment, the game might include features such as a card draw or discard feature. For example, it might be possible to allow the player to discard and replace one or more cards after the player has already swapped or exchanged one or more cards with the dealer.

It is also possible for the player/dealer card swap feature to apply to games other than poker. For example, if might be possible to allow a player to swap on or more cards with a dealer in a blackjack type game.

As described above, the game of the invention may be implemented as a primary game based upon a direct wager. The game might be implemented, however, in other fashions. For example, in one embodiment of the invention a player may be presented with a standard video poker game in response to a base wager. For example, a player might be presented with a standard five (5) card draw video poker game in response to placing a base wager such as five (5) credits. The player might be given the opportunity to implement the card exchange feature of the present invention based upon one or more criteria. Such criteria might comprise one or more events, such as a prior winning outcome, reaching a certain level of player or the like, or upon placing a feature enabling wager. The feature-enabling wager might comprise, for example, one or more additional credits beyond the base wager. In this example, a player who places a five (5) credit wager may play each hand in standard draw poker fashion, but if the player places a six (6) credit wager (or other wager greater than the base wager), the player may be presented the above-described poker game having the card exchange feature. Of course, this configuration might be applied to various base games (for example, the base game which is presented upon placing a base wager might comprise Five Card Stud, Seven Card Stud or the like, but upon an additional or greater wager, the game of the invention or card exchange feature may be implemented or presented).

In the above-described arrangement, the extra wager might "convert" the game from a base game to the card exchange version of the game. In other embodiment, the extra wager might permit the player to play both games. For example, a player might place a base wager to play a Five Card Stud poker game, wherein the results of the initial five cards dealt to the player are evaluated against a base pay table. If the player has placed the additional wager, the player may then also have the opportunity to improve that hand by exchanging cards with another hand as described above, and be given the chance for an award based upon a second pay table. In that embodiment, for example, the player might obtain two payouts or awards for winning results of the stud and card exchange hands.

In one embodiment of the invention, a player might be awarded winnings based upon whether the player's hand comprises a predetermined winning hand, such as when compared to a pay table of winning hands, even if the player's hand does not beat the dealer's hand. If the player's hand beats the dealer's hand, the player may be awarded a larger award.

One example of a payout matrix or pay table for such an embodiment of the game is illustrated below:

TABLE 2

| PAYOUT MATRIX | | | | | | | | | | | | |
|---|---|---|---|---|---|---|---|---|---|---|---|---|
| | RF | SF | 4aces | FOAK | FH | FL | ST | TOAK | TP | JJ+ | OP | HC |
| RF | | 8000 | 8000 | 8000 | 8000 | 8000 | 8000 | 8000 | 4000 | 2400 | 800 | 800 |
| SF | 100 | | 1000 | 1000 | 1000 | 1000 | 1000 | 1000 | 500 | 300 | 100 | 100 |
| 4aces | 100 | 100 | | 1000 | 1000 | 1000 | 1000 | 1000 | 500 | 300 | 100 | 100 |
| FOAK | 80 | 80 | 80 | | 800 | 800 | 800 | 800 | 400 | 240 | 80 | 80 |
| FH | 35 | 35 | 35 | 35 | | 700 | 700 | 700 | 350 | 105 | 35 | 35 |
| FL | 20 | 20 | 20 | 20 | 20 | | 400 | 400 | 200 | 60 | 20 | 20 |
| ST | 9 | 9 | 9 | 9 | 9 | 9 | | 180 | 90 | 27 | 9 | 9 |
| TOAK | 5 | 5 | 5 | 5 | 5 | 5 | 5 | | 50 | 15 | 5 | 5 |
| TP | 2 | 2 | 2 | 2 | 2 | 2 | 2 | 2 | | 4 | 2 | 2 |
| JJ+ | 1 | 1 | 1 | 1 | 1 | 1 | 1 | 1 | 1 | | 1 | 1 |
| OP | 0 | 0 | 0 | 0 | 0 | 0 | 0 | 0 | 0 | 0 | | 0 |
| HC | 0 | 0 | 0 | 0 | 0 | 0 | 0 | 0 | 0 | 0 | 0 | |

The Payout Matrix (TABLE 2):

This table illustrates one embodiment of the amount of winnings based upon the player's final hand (wherein the designators RF=Royal Flush, SF=Straight Flush, 4aces=4 Aces, FOAK=Four of a Kind, FH=Full House, FL=Flush, ST=Straight, TOAK=Two of a Kind, TP=Two Pair, JJ+=Pair of Jacks or Better, OP=One Pair, and HC=High Card). The player's final hand is designed in each row, while the columns designate the pay table hands and dealer hands. As illustrated, the player may receive two potential awards. First, the player may receive an award for a hand which comprises one of the predetermined winning outcomes, i.e. base pay table hands (which awards are shown in the bottom set of award boxes). In addition, the player may receive a further award for a player hand which beats the dealer's hand (which awards are shown in the top set of award boxes). For example, if the player's final hand comprises 4 Aces, then the player receives an award of 100 credits (for each credit wagered), as a result of that hand comprising a base pay table winning hand (even if the player's hand did not beat the dealer's hand). In addition, if the dealer only has Two Pairs, then the player would be awarded an additional 500 credits (for each credit wagered) as a result of the player's 4 Aces hand beating the dealer's Two Pair hand.

TABLE 3

| Expected payout of the game for player |
|---|
| 0.994000816 |

Expected Payout (TABLE 3):

This is the average expected payout of the game for the player over time. On average, a player should expect to receive this amount of credits back per game for each credit he inserts. In the example the expected return is 0.994 credits. This correspondingly means that the "house hold", or the amount on average which is won from all player wagers by the house, is 0.006 credits per game.

TABLE 4

| X |
|---|
| 1 |

Fixed Cost (TABLE 4):

This is the fixed cost of the game in addition the credits gambled. In this example the cost is one, this means that the player pays one credit to play the game and then inserts however many credits he would like to gamble with.

TABLE 5

| | | Multiplier Beats XX | | |
|---|---|---|---|---|
| | Baseline | JJ+ | TP | TOAK+ |
| RF | 800 | 3 | 5 | 10 |
| SF | 100 | 3 | 5 | 10 |
| 4aces | 100 | 3 | 5 | 10 |

TABLE 5-continued

| | | Multiplier Beats XX | | |
|---|---|---|---|---|
| | Baseline | JJ+ | TP | TOAK+ |
| FOAK | 80 | 3 | 5 | 10 |
| FH | 35 | 3 | 10 | 20 |
| FL | 20 | 3 | 10 | 20 |
| ST | 9 | 3 | 10 | 20 |
| TOAK | 5 | 3 | 10 | 20 |
| TP | 2 | 2 | 3 | N/A |
| JJ+ | 1 | 2 | N/A | N/A |
| OP | 0 | N/A | N/A | N/A |
| HC | 0 | N/A | N/A | N/A |

Multiplier Matrix (TABLE 5):

This matrix is what determines the total player awards.

The first column indicates the awards for winning player hands for base pay table wins (i.e. receiving a predetermined winning outcome whether or not the player's hand beats the dealer's hand). Each of the remaining columns shows an additional multiplier on the baseline prize which applies in case the player's hand beats the dealer's hand. For example, as indicated above, if the player has a 4 Aces hand which beats a dealer's Two Pairs hand, the multiplier is 5, such that the corresponding award is 5× the base award (100 credits in this example), or 500 credits.

TABLE 6

| | Diagonal Payout | | |
|---|---|---|---|
| Hand | P1 wins | P2 wins | Tie |
| RF | 8000 | 800 | 800 |
| SF | 1000 | 100 | 100 |
| 4aces | 1000 | 100 | 100 |
| FOAK | 800 | 80 | 80 |
| FH | 700 | 35 | 35 |
| FL | 400 | 20 | 20 |
| ST | 180 | 9 | 9 |
| TOAK | 100 | 5 | 5 |
| TP | 6 | 2 | 2 |
| JJ+ | 2 | 1 | 1 |
| OP | 0 | 0 | 0 |
| HC | 0 | 0 | 0 |

Diagonal Matrix (TABLE 6):

A player's hand and the dealer's hand may have the same rank (i.e. "tie"). As illustrated in the payout matrix, one outcome may be that the player is not awarded any award in the event of a tie. As illustrated in the Diagonal Matrix, in another embodiment, a player may be paid an award for a tie.

Of course, it will be appreciated that the above Tables 2-6 illustrate but one embodiment of a configuration of awards for such a game.

In accordance with another embodiment of the invention, the game might be played as a multi-hand game. For example, a player might elect to play their hand against two or more dealer hands (which may be played by the computer, one or more dealers or other players), wherein the player may exchange cards with each of those dealer hands.

Figure 3A:
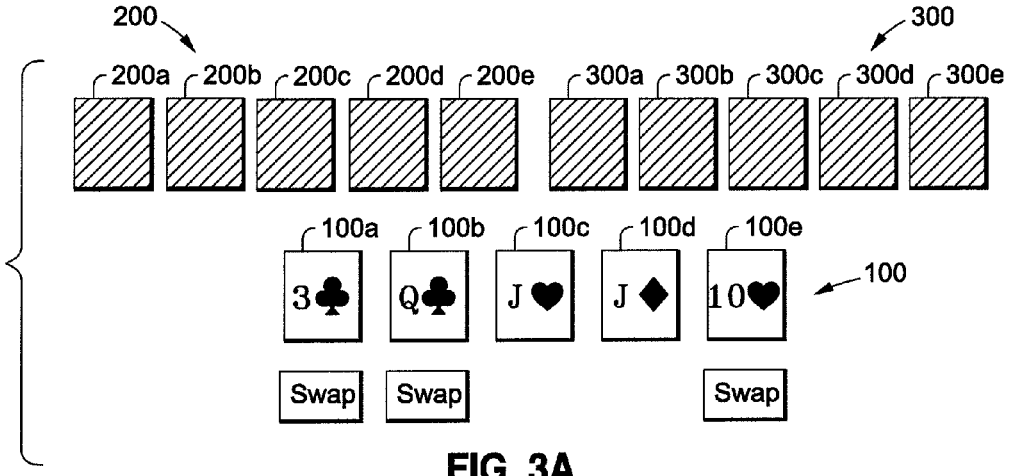
FIGS. 3A-3C illustrate another example of game play in accordance with another embodiment of a game of the invention.
Figure 3B:
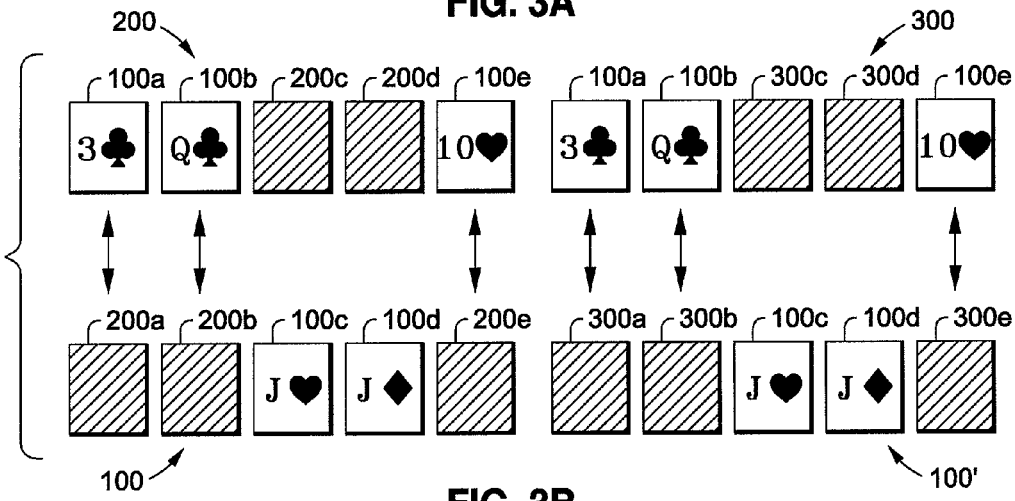
Figure 3C:
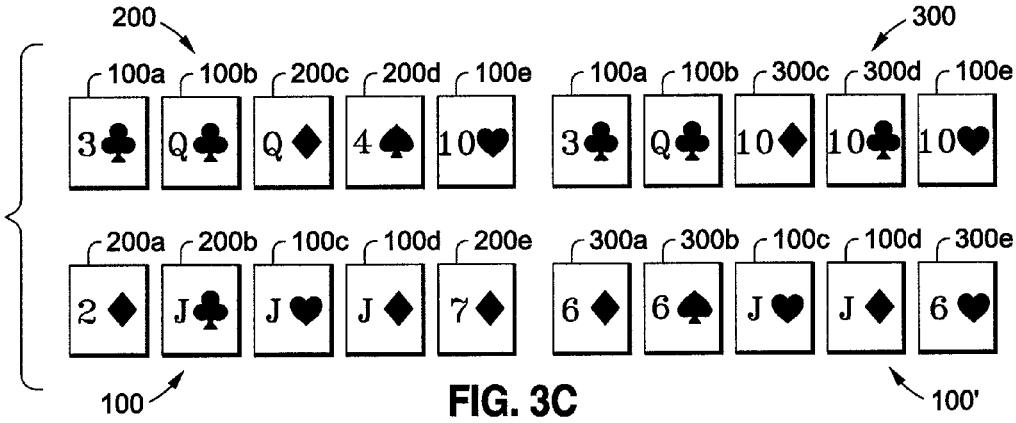

One example of this configuration of the invention is illustrated in FIGS. 3A-3C. In this example, a player has elected to play their single player hand against two dealer hands. The player is initially dealt five cards 100*a-e* to form an initial player hand 100. Each dealer hand is also dealt five cards 200*a-e* and 300*a-e* to form an initial first dealer hand 200 and an initial second dealer hand 300. Preferably, all of the cards used in the hands are dealt from the same deck or shoe of cards.

In one embodiment, as illustrated in FIG. 3A, the player may elect to exchange their first card 100*a* (the Three of Clubs), second card 100*b* (Queen of Clubs) and fifth card 100*e* (Ten of Hearts) with the corresponding cards in each dealer hand. Because the cards in each dealer hand differ, the swap of these cards with the two dealer hands 200,300 results in two new player hands 100, 100', as illustrated in FIG. 3B.

In the example illustrated, the result of the player's card swap has resulted in a first player hand 100 having a Three of a Kind (including the original Jack of Hearts and Jack of Diamonds as originally dealt to the player, plus the Jack of Clubs received from the first dealer hand 200), which beats the first dealer hand 200, which only comprises Two Pair (the Queen of Clubs and Queen of Diamonds). In addition, the player's card swap has resulted in a second player hand 100' having a Full House (including the original Jack of Hearts and Jack of Diamonds as originally dealt to the player, plus the Six of Diamonds, the Six of Spades and the Six of Hearts from the second dealer hand 300), which beats the second dealer hand 300, which only comprises a Three of a Kind (the Ten of Diamonds, Ten of Clubs and Ten of Hearts).

Preferably, the player is paid or awarded winnings based upon the outcome of the game play against each dealer hand, such as in the manner(s) described herein. For example, the player may be paid a first award based upon the player's first hand 100 beating the first dealer hand 200 and a second award based upon the player's second hand 100' beating the second dealer hand 300. Of course, as indicated herein, the player might also be paid an award because each of the player's hand comprised a predetermined winning outcome (such as in accordance with a base pay table of outcomes). In addition, the player might be paid additional winnings or higher winnings because the player beat both dealer hands.

Of course, the player preferably again places a wager to play the game. The player may be required to place a separate wager to play against each dealer hand. The wager placed against each dealer hand might be the same or it might vary. Of course, the awards for winning outcomes might also vary depending upon the size of the player's wager(s).

It will be appreciated that the player might play against more than two dealer hands, such as 5, 10 or even 100 or more hands. In embodiments in which all of the cards used in the game are dealt from the same deck, the player could only play against a maximum of 9 dealer hands (comprising 45 cards, which plus the player's hand of 5 cards, would total 50 of the 52 cards in the deck). However, each of the player and the dealer hands could be dealt from different decks or from a shoe or set of multiple combined decks, thereby permitting the player to play against a greater number of hands.

It is also possible for a player to play against multiple dealer hands in other fashions. For example, it is possible to deal a separate player hand corresponding to each dealer hand. The player may then pick the cards in each player hand to swap with each corresponding dealer hand (rather than picking the cards from a single dealer hand to be swapped with multiple dealer hands).

It possible for the game of the invention to be presented as a bonus game. For example, a player may place a wager to place a base game such as a game of slots. That player may be given the opportunity to enter a bonus event at one or more times, such as based upon a random bonus award or upon a certain bonus event trigger such as a particular base game outcome. The bonus event might comprise one or more hands of card exchange poker as detailed above. In such an event, the player may not be required to place an additional wager to play the one or more hands of card exchange poker (or might still be required to place an additional wager beyond the wager required to play the base game) and may be awarded bonus winnings based upon outcomes of the card exchange poker hands.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A method of playing a game at a gaming machine comprising the machine-implemented steps of:

accepting a wager from at least one player to play a game;

displaying a first set of cards comprising an initial first dealer hand on at least one electronic display of said gaming machine;

displaying a second set of card comprising an initial second dealer hand on at least one electronic display of said gaming machine;

displaying a third set of cards comprising an initial player hand on said at least one electronic display of said gaming machine;

accepting input from said player regarding none, one or more or all of said cards of said second set of cards to be exchanged with cards in said initial first and second dealer hands via at least one input device of said gaming machine;

exchanging any cards from said initial player hand which are elected by said player to be exchanged with a corresponding number of cards from said first and second dealer hands;

forming a first final player hand comprising said third set of cards as modified with any cards exchanged with cards from said initial first dealer hand;

forming a second final player hand comprising said third set of cards as modified with any cards exchanged with cards from said initial second dealer hand;

forming a final first dealer hand comprising said first set of cards as modified with any cards exchanged with cards from said player's initial hand;

forming a final second dealer hand comprising said second set of cards as modified with any cards exchanged with cards from said player's initial hand;

determining an outcome of said game relative to said first dealer hand by comparison of said player's first final hand to said final first dealer hand; and determining an outcome of said game relative to said second dealer hand by comparison of said player's second final hand to said final second dealer hand.

2. The method in accordance with claim 1 wherein said first set of cards, said second set of cards and said third set of cards each comprise five cards.

3. The method in accordance with claim 1 wherein said cards in said first, second and third sets have corresponding positions and said step of exchanging comprises exchanging cards in corresponding positions between said player's initial hand and said initial first dealer hand and said player's initial hand and said initial second dealer hand.

4. The method in accordance with claim 1 further comprising the step of awarding winnings to said player if said player is determined to be the winner of said game.

5. The method in accordance with claim 4 further comprising the step of determining a rank of said first final player hand, said second player final hand, said final first dealer hand and said final second dealer hand, awarding winnings if said rank of said first final player hand is greater than said rank of said final first dealer hand and awarding winnings if said rank of said second final player hand is greater than said rank of said final second dealer hand.

6. The method in accordance with claim 4 further comprising the step of awarding winnings to said player if said first final player hand beats or ties said final first dealer hand and/or if said second final player hand beats or ties said final second dealer hand.

7. The method in accordance with claim 4 further comprising displaying one or more sets of additional cards corresponding to one or more additional first dealer hands, wherein said step of exchanging further comprises exchanging cards with said one or more sets of additional cards, forming an additional final dealer hand corresponding to each additional set of cards and forming an additional final player hand corresponding to each additional set of cards and determining an outcome of said game relative to said additional final player hands and final dealer hands.

* * * * *